US010825589B2

(12) United States Patent
Iwasaki et al.

(10) Patent No.: US 10,825,589 B2
(45) Date of Patent: Nov. 3, 2020

(54) R-T-B BASED RARE EARTH MAGNET

(71) Applicant: TDK CORPORATION, Tokyo (JP)

(72) Inventors: Makoto Iwasaki, Tokyo (JP); Tetsuya Hidaka, Tokyo (JP); Eiji Kato, Tokyo (JP); Takuma Hayakawa, Tokyo (JP); Hidetake Kitaoka, Tokyo (JP)

(73) Assignee: TDK CORPORATION, Tokyo (JP)

( * ) Notice: Subject to any disclaimer, the term of this patent is extended or adjusted under 35 U.S.C. 154(b) by 351 days.

(21) Appl. No.: 15/928,378

(22) Filed: Mar. 22, 2018

(65) Prior Publication Data

US 2018/0277288 A1 Sep. 27, 2018

(30) Foreign Application Priority Data

Mar. 22, 2017 (JP) ..... 2017-056585
Mar. 16, 2018 (JP) ..... 2018-049484

(51) Int. Cl.

| | |
|---|---|
| ***H01F 1/057*** | (2006.01) |
| ***C22C 38/16*** | (2006.01) |
| ***C22C 38/14*** | (2006.01) |
| ***C22C 38/10*** | (2006.01) |
| ***C22C 38/06*** | (2006.01) |
| ***C22C 38/04*** | (2006.01) |
| ***C22C 38/00*** | (2006.01) |
| ***C22C 30/02*** | (2006.01) |

(Continued)

(52) U.S. Cl.

CPC ..... *H01F 1/057* (2013.01); *C22C 30/02* (2013.01); *C22C 38/002* (2013.01); *C22C 38/005* (2013.01); *C22C 38/04* (2013.01); *C22C 38/06* (2013.01); *C22C 38/10* (2013.01); *C22C 38/14* (2013.01); *C22C 38/16* (2013.01); *H01F 1/0577* (2013.01); *B22F 1/0011* (2013.01); *B22F 3/26* (2013.01); *B22F 9/023* (2013.01); *B22F 9/04* (2013.01); *B22F 2003/242* (2013.01); *B22F 2003/247* (2013.01); *B22F 2009/044* (2013.01); *B22F 2009/045* (2013.01); *B22F 2207/13* (2013.01); *B22F 2301/355* (2013.01); *B22F 2304/10* (2013.01); *B22F 2998/10* (2013.01); *B22F 2999/00* (2013.01); *C22C 2202/02* (2013.01)

(58) Field of Classification Search

CPC ..... H01F 1/057; C22C 30/02; C22C 38/00
See application file for complete search history.

(56) References Cited

U.S. PATENT DOCUMENTS

2010/0233016 A1 9/2010 Tsubokura et al.
2012/0247624 A1* 10/2012 Sakuma ..... H01F 1/0571 148/538

(Continued)

FOREIGN PATENT DOCUMENTS

| | | | |
|---|---|---|---|
| CN | 105849828 | A | 8/2016 |
| JP | 2009-10305 | A | 1/2009 |
| WO | 2009/004994 | A1 | 1/2009 |

*Primary Examiner* — Christopher S Kessler
*Assistant Examiner* — Jiangtian Xu
(74) *Attorney, Agent, or Firm* — Oliff PLC

(57) ABSTRACT

Provided is an R-T-B based rare earth magnet. R is one or more rare earth elements, T is one or more transition metal elements essentially including Fe or Fe and Co, and B is boron. B content with respect to a total R-T-B based rare earth magnet is 0.80 mass % or more and 0.98 mass % or less. The R-T-B based rare earth magnet includes an $R_1T_4B_4$ phase.

16 Claims, 4 Drawing Sheets

(51) Int. Cl.

| | |
|---|---|
| *B22F 9/04* | (2006.01) |
| *B22F 9/02* | (2006.01) |
| *B22F 3/26* | (2006.01) |
| *B22F 1/00* | (2006.01) |
| *B22F 3/24* | (2006.01) |

(56) References Cited

U.S. PATENT DOCUMENTS

| | | | | |
|---|---|---|---|---|
| 2016/0322159 | A1 | 11/2016 | Sakuma et al. | |
| 2018/0158583 | A1* | 6/2018 | Masusawa | H01F 1/057 |

* cited by examiner

R-T-B BASED RARE EARTH MAGNET

BACKGROUND OF THE INVENTION

1. Field of the Invention

The present invention relates to an R-T-B based rare earth magnet.

2. Description of the Related Art

R-T-B based rare earth magnets have been used in a wide variety of fields since they show superior magnetic properties, and in recent years, the field of the use has been increasing more due to dramatic improvement of the magnetic properties of R-T-B based rare earth magnets. In the market, further improvement is expected for the magnetic properties of R-T-B based rare earth magnets.

For instance, Patent Document 1 describes an R-T-B based rare earth magnet having a composition with a low B (boron) content. It is stated that a B-rich phase is not formed by lowering the B content, and a magnet having a high residual magnetic flux density is obtained. In concrete, making the B content in the R-T-B based magnet represented by $R_2T_{14}B$ to a level slightly lower than the stoichiometric ratio in $R_2T_{14}B$, the amount of the B-rich phase to be formed remarkably decreases, the volume ratio of a main phase composed of an $R_2T_{14}B$ phase is improved, and a high residual magnetic flux density (Br) can be obtained.

In addition, Patent Document 2 describes a method for producing a rare earth magnet in which a compound having a high melting point is added. In particular, by adding a compound of a heavy rare earth element(S), including Dy and/or Tb, and B or Al as the compound having a high melting point, the magnetic properties, particularly coercive force (HcJ) can be improved.

Patent Document 1: WO 2009/004994

Patent Document 2: JP-A-2009-10305

SUMMARY OF THE INVENTION

When the B content is set to be lower than the stoichiometric ratio in $R_2T_{14}B$ and the amount of the B-rich phase to be formed is decreased as described in Patent Document 1, the property stability is lowered, and the range of the sintering temperature at which suitable properties can be obtained is narrowed. It is also possible to improve the property stability by adding a compound of a heavy rare earth element(s) having a high melting point as described in Patent Document 2. However, since the compound having a high melting point reacts with a liquid phase in the sintering process, the compound melts down during the sintering process, so the effect of improving the property stability is not large.

An object of the present invention is to obtain an R-T-B based rare earth magnet which has improved magnetic properties and a wide optimal temperature range for the sintering.

In order to achieve the above object, the R-T-B based rare earth magnet of the invention is an R-T-B based rare earth magnet, wherein R is one or more rare earth elements, T is one or more transition metal elements essentially including Fe or Fe and Co, and B is boron. A B content with respect to a total R-T-B based rare earth magnet is 0.80 mass % or more and 0.98 mass % or less. The R-T-B based rare earth magnet includes an $R_1T_4B_4$ phase.

With the above configuration, the R-T-B based rare earth magnet of the invention improves the magnetic properties and has a wide optimal temperature range for sintering.

The R-T-B based rare earth magnet of the invention may include a heavy rare earth element(s) HR as a rare earth element(s) R in the $R_1T_4B_4$ phase, and shows $\alpha_{HR/R} \geq 5$ wherein $\alpha_{HR/R}$ (mass %) is a ratio of the heavy rare earth element(s) HR with respect to the rare earth element(s) R in the $R_1T_4B_4$ phase.

The R-T-B based rare earth magnet of the invention may shows $\alpha_{HR/R} \geq \beta_{HR/R}$ wherein the $\beta_{HR/R}$ (mass %) is a ratio of the heavy rare earth element(s) HR with respect to the rare earth element(s) R in the R-T-B based rare earth magnet.

The R-T-B based rare earth magnet of the invention may have a concentration gradient of the heavy rare earth element(s) from the surface of the magnet toward the inside of the magnet.

In the R-T-B based rare earth magnet of the invention, the existence ratio of the $R_1T_4B_4$ phase in the cross section of the R-T-B based rare earth magnet may be 1/24.5 or more.

In the R-T-B based rare earth magnet of the invention, the average of the equivalent circle diameter of the $R_1T_4B_4$ phase in the cross section of the R-T-B based rare earth magnet may be 50 μm or more.

DESCRIPTION OF THE PREFERRED EMBODIMENTS

Figure 1:
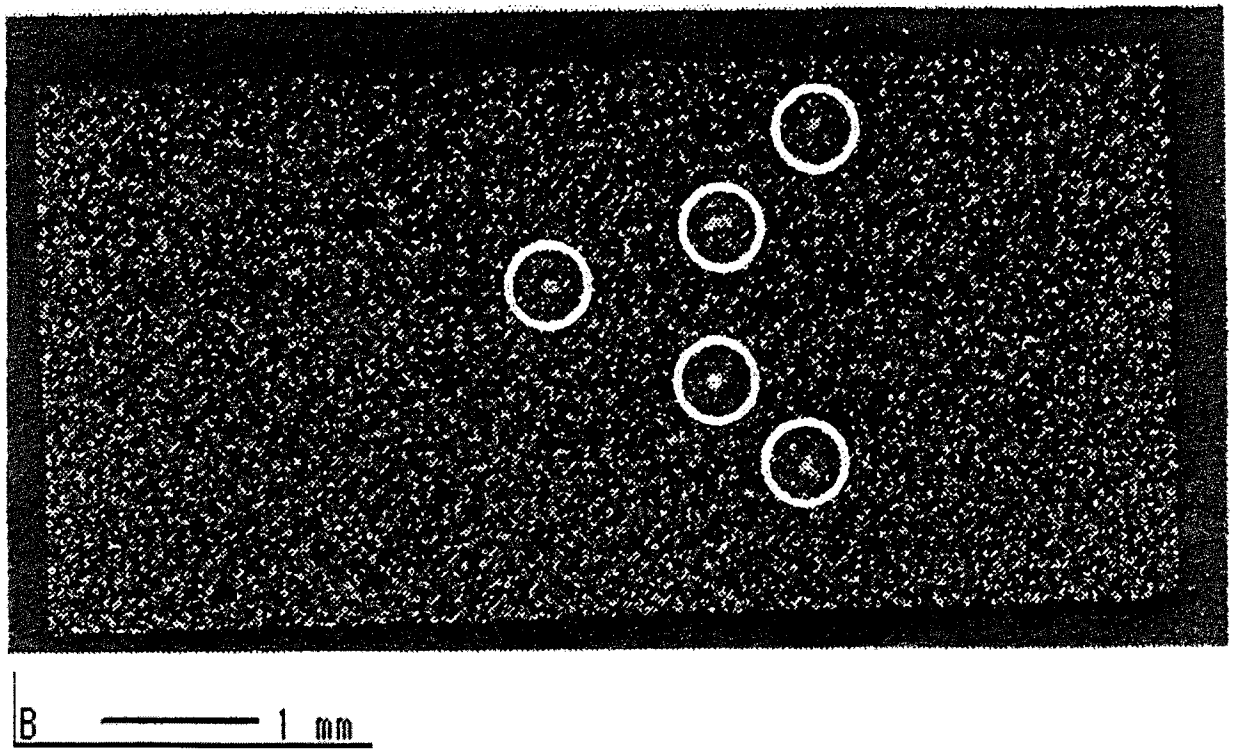
FIG. 1 is a mapping image of B by EPMA in Example 2.

Hereinafter, the present invention is described based on the embodiments shown in the drawings.

<R-T-B Based Rare Earth Magnet>

The R-T-B based rare earth magnet according to the present embodiment includes an $R_2T_{14}X$ phase, an $R_1T_4B_4$ phase and a grain boundary.

R is one or more rare earth elements. The rare earth elements are Sc, Y and lanthanoid elements belonging to the third group of the long-period type periodic table. Examples of the lanthanoid elements include La, Ce, Pr, Nd, Sm, Eu, Gd, Tb, Dy, Ho, Er, Tm, Yb, and Lu.

The R content is preferably 27 mass % or more and 34 mass % or less, more preferably 29 mass % or more and 32 mass % or less. High magnetic properties are obtained by setting the R content within the above range, which is preferable. The kind of R is not particularly limited, but it is preferable to use one or more rare earth elements including Nd.

T is one or more transition metal elements essentially including Fe or Fe and Co. Fe is a substantial balance of the R-T-B based rare earth magnet according to the present embodiment. The Co content is preferably more than zero mass % and three mass % or less. High magnetic properties and a high corrosion resistance are obtained by setting the Co content within the above range, which is preferable.

B is boron. The B content is 0.80 mass % or more and 0.98 mass % or less, and preferably 0.85 mass % or more and 0.96 mass % or less. When the B content is not less than the predetermined value, Br and the squareness ratio can be improved. When the B content is the predetermined value or less, Br and HcJ can be improved.

X is B or carbon. In the R-T-B based rare earth magnet according to the present embodiment, the carbon content is preferably 0.03 mass % or more and 0.15 mass % or less. By setting the carbon content to 0.03 mass % or more, the magnetic properties can be improved. Further, by setting the carbon content to 0.15 mass % or less, it becomes easy to suppress the occurrence of different phases such as an $R_2T_{17}$ phase, and suppress the decrease in HcJ due to the occurrence of different phases.

The physical properties of the $R_2T_{14}X$ phase are changed and the magnetic properties (Br and/or HcJ) are improved by dissolving not only B but carbon as "X" of the $R_2T_{14}X$ phase in solution. Compared with B, however, carbon is less likely to dissolve. Therefore, if the B content is decreased and the carbon content is increased simply, the $R_2T_{14}X$ phase is not sufficiently formed during the sintering process mentioned later, a different phase such as an $R_2T_{17}$ phase precipitates, and HcJ sharply decreases.

Here, when the $R_1T_4B_4$ phase is present during the later-mentioned sintering process, the liquid phase (forming, for example, the $R_2T_{14}X$ phase at the time of cooling) generated during the sintering process and the $R_1T_4B_4$ phase continue a constant amount of reaction and continue to supply B to the liquid phase. This can serve as a buffer for suppressing the occurrence of different phases such as an $R_2T_{17}$ phase. As a result, the existence of the $R_1T_4B_4$ phase allows the $R_2T_{14}X$ phase to be formed sufficiently, and the magnetic properties, especially HcJ, can be remarkably improved.

Further, when the $R_1T_4B_4$ phase is generated in the later-mentioned sintering process, the $R_1T_4B_4$ phase also exists in the finally obtained sintered body. According to the ternary phase diagram (not shown) of NdFeB, an $Nd_1Fe_4B_4$ phase or an $Nd_5Fe_2B_6$ phase remains as the solid phase to the highest temperature in the solid-liquid coexistence region in which the liquid phase and the solid phase coexist. Considering the above, it is considered that the $R_1T_4B_4$ phase hardly turns into the liquid phase through the sintering process and remains as the $R_1T_4B_4$ phase.

Furthermore, it is considered that the $R_1T_4B_4$ phase functions to prevent magnetic domain wall movement. Therefore, when the $R_1T_4B_4$ phase is included, it is considered that the magnetic domain wall movement is prevented and HcJ is improved.

Furthermore, it is preferable that the R-T-B based rare earth magnet of the present embodiment includes either or both of Dy and Tb as the heavy rare earth element(s). The HcJ is improved by including the heavy rare earth element(s). It is more preferable that at least Dy is included as the heavy rare earth element.

In addition, when the $R_1T_4B_4$ phase includes a heavy rare earth element(s) as R, it is possible to continue to stably supply the heavy rare earth element(s) to the liquid phase during the later-mentioned sintering process. For this reason, the finally formed $R_2T_{14}X$ phase tends to have a core-shell structure. Therefore, the magnetic properties tend to improve. In addition, when the $R_1T_4B_4$ phase includes a heavy rare earth element(s) as "R", it is possible to continue to stably supply a heavy rare earth element(s) to the liquid phase during the later-mentioned sintering process, so that the finally obtained R-T-B based rare earth magnet has a high stability with respect to sintering temperature. In concrete, even if sintering temperature changes, the squareness ratio hardly decreases, and an optimal temperature range for the sintering widens.

The R-T-B based rare earth magnet according to the present embodiment may have the concentration gradient of the heavy rare earth element(s) from the surface of the magnet toward the inside of the magnet. In particular, it may have the concentration gradient in which the concentration of the heavy rare earth element(s) decreases from the surface of the magnet toward the inside of the magnet. There is no particular limitation on the method of generating the concentration gradient of the heavy rare earth element(s). For example, it is possible to generate the concentration gradient of the heavy rare earth element(s) by performing a diffusion described below.

In addition, it is preferable that the R-T-B based rare earth magnet according to the present embodiment further includes Al, Cu, Zr and/or Mn.

The Al content is preferably 0.03 mass % or more and 0.4 mass % or less. By setting the Al content within the above range, HcJ can be improved. The Cu content is preferably 0.01 mass % or more and 0.3 mass % or less. When the Cu content is within the above range, HcJ can be improved. The Zr content is preferably 0.03 mass % or more and 0.7 mass % or less. When the Zr content is within the above range, the sintering temperature stability can be improved. The Mn content is preferably 0.01 mass % or more and 0.1 mass % or less. By setting the Mn content within the above range, the squareness ratio (Hk/HcJ) can be improved.

In addition, the R-T-B based rare earth magnet according to the present embodiment may further include O (oxygen). The O content is preferably 0.3 mass % or less. By setting the O content to 0.3 mass % or less, HcJ is improved. Also, the O content can be controlled by controlling the O concentration in the process.

The Fe content is a substantial balance in the components of the R-T-B based rare earth magnet.

Hereinafter, the existence ratio (a value, in which a number of the $R_1T_4B_4$ phases is divided by an area ($mm^2$) of a measurement range), size and composition of the $R_1T_4B_4$ phase in the R-T-B based rare earth magnet according to this embodiment will be described.

Figure 2:
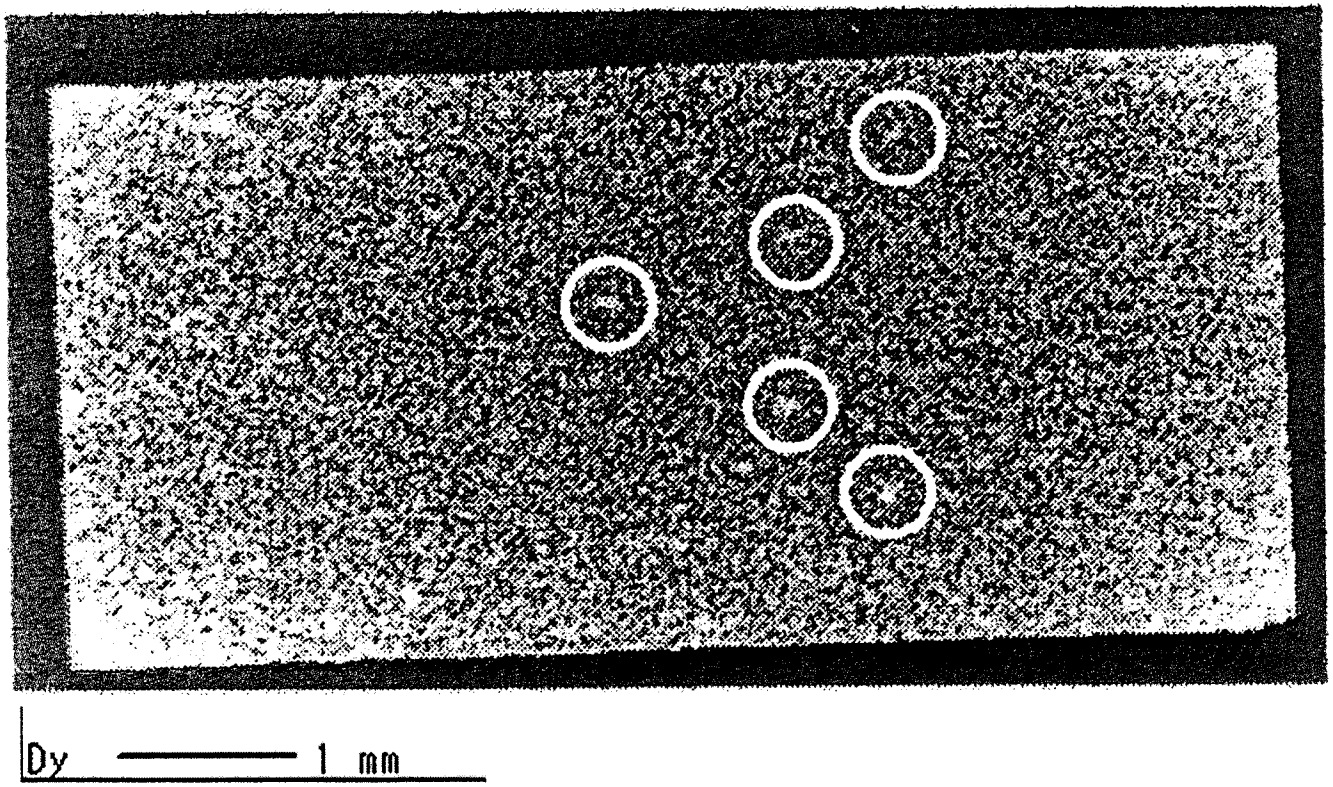
FIG. 2 is a mapping image of dysprosium by EPMA in Example 2.

First, the R-T-B based rare earth magnet is cut at an arbitrary cross section, and the cross section is observed using EPMA. The results of EPMA observation of the cross section in the later-mentioned Example 2 are shown in FIGS. 1 and 2. FIG. 1 shows the result of mapping by measuring the B concentration, and FIG. 2 shows the result of mapping by measuring the concentration of Dy. The magnification of the mapping is preferably 5 times or more and 200 times or less. The measurement range is preferably 25 $mm^2$ or more. In the later-mentioned Example 2, Nd and Dy are included as the rare earth elements R.

In FIG. 1, the white color portion has a higher B concentration. Also, in FIG. 2, the white color portion has a higher Dy concentration. In FIG. 1, the B concentration is higher in the place marked with a circle relative to the surrounding area. Such a place is the $R_1T_4B_4$ phase. The surrounding place, where the B concentration is low, is the $R_2T_{14}B$ phase (main phase) and the grain boundaries. In FIG. 2, the place marked with a circle is the same as the place marked with the circle in FIG. 1. From FIG. 2, the Dy concentration in the $R_1T_4B_4$ phase is higher than the surrounding $R_2T_{14}B$ phase and the grain boundaries.

Figure 3:
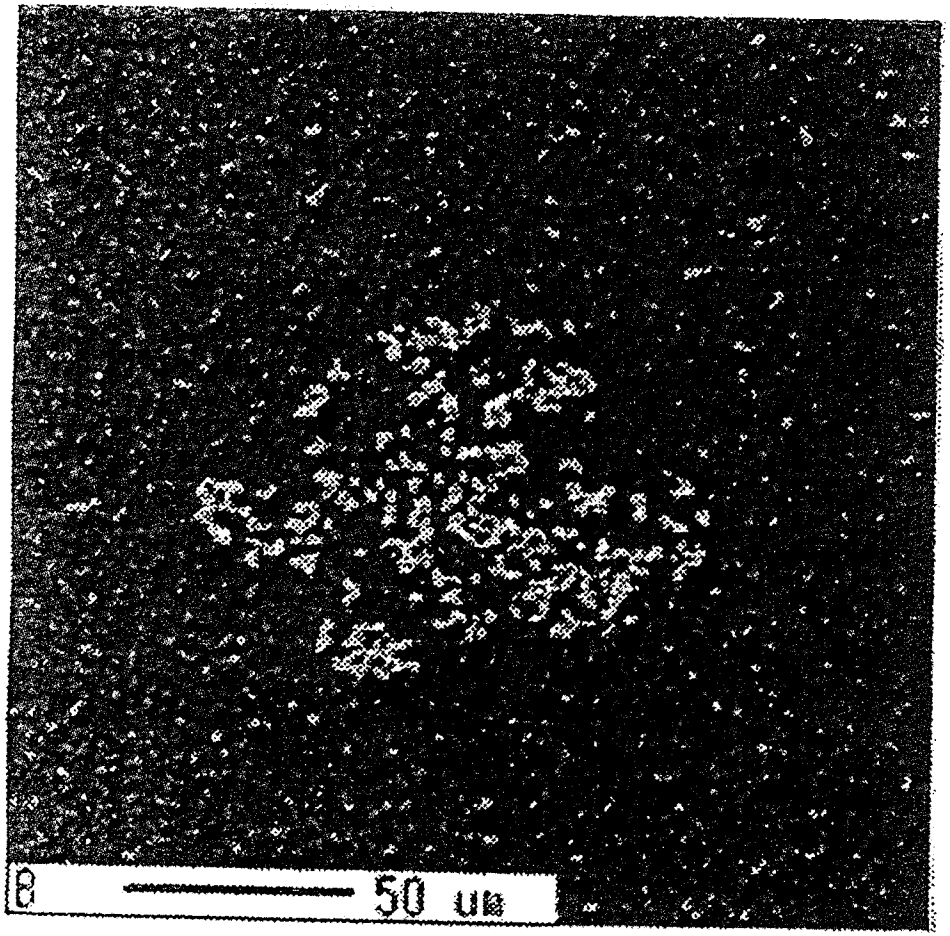
FIG. 3 is an enlarged view of a region ($R_1T_4B_4$ phase) having a high B concentration in FIG. 1.
Figure 4:
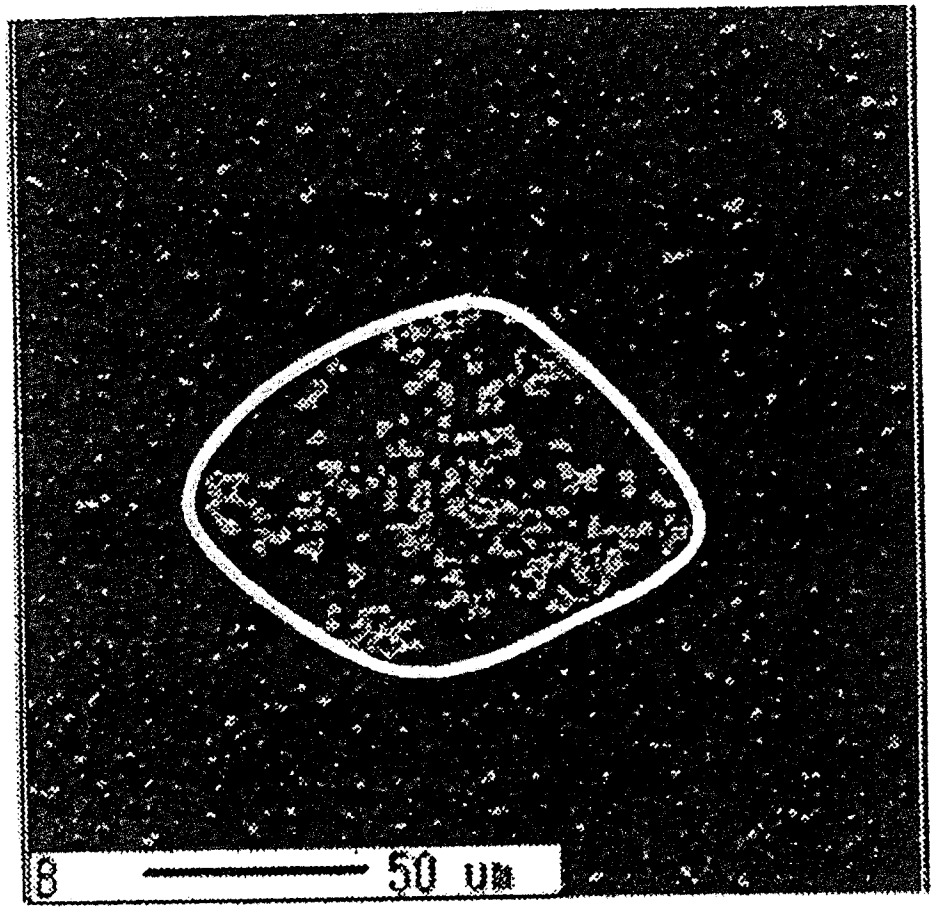
FIG. 4 is a view showing an outer periphery of the $R_1T_4B_4$ phase in FIG. 3.

FIGS. 3 and 4 are images obtained by enlarging one of the places marked with circles in FIG. 1. It is shown that the portion having a high B concentration (brighter portion) and the portion having a low B concentration (darker portion) are present mixedly. In measuring the existence ratio and the size of the $R_1T_4B_4$ phase, as shown in FIG. 4, a line is drawn at the outer periphery of the region where many $R_1T_4B_4$ phases are present, and the entire inside of the line is regarded as one $R_1T_4B_4$ phase. Depending on how the line is drawn, the size and the composition of the later-mentioned $R_1T_4B_4$ phase may slightly change, but it is considered to be within the range of the measurement error. The existence ratio of the $R_1T_4B_4$ phases is, when the R-T-B based rare earth magnet is cut at an arbitrary cross section, a number of the $R_1T_4B_4$ phases observed in the cross section divided by a cross sectional area of the cross section.

In the present embodiment, it is preferable that the size of the $R_1T_4B_4$ phase is such that the average equivalent circle diameter of the $R_1T_4B_4$ phase is 50 μm or more. The equivalent circle diameter of a certain region is the diameter of a circle which has the same area as the area of the certain region. The equivalent circle diameter of the $R_1T_4B_4$ phase can be measured by measuring the area of one $R_1T_4B_4$ phase specified by EPMA mapping image and calculating the diameter of a circle having the same area as the measured area. Then, the equivalent circle diameter of the $R_1T_4B_4$ phase existing in the measurement region is measured.

Here, when the equivalent circle diameter of the $R_1T_4B_4$ phase is less than 10 μm, this region is not regarded as the $R_1T_4B_4$ phase in calculation of an average of equivalent circle diameters, calculation of the existence ratio of the $R_1T_4B_4$ phase and calculation of the composition of the $R_1T_4B_4$ phase, described later.

In the present embodiment, the average of the equivalent circle diameters of the $R_1T_4B_4$ phase is preferably 50 μm or more. When the size of the $R_1T_4B_4$ phase is within the above range, the effect obtained by including the above $R_1T_4B_4$ phase is more easily exerted. In particular, the sintering stability tends to be improved. There is no upper limit in the average equivalent circle diameter, but it is possible to raise the average of equivalent circle diameters to approximately 100 μm.

In the present embodiment, the existence ratio of the $R_1T_4B_4$ phase is preferably 1/24.5 (portion/$mm^2$) or more. That is, the value obtained by dividing the number of the $R_1T_4B_4$ phases by an area (unit: $mm^2$) of the measurement range is preferably 1/24.5 or more. When the existence ratio of the $R_1T_4B_4$ phase is within the above range, the effect exerted by including the $R_1T_4B_4$ phase is more easily exerted. Although there is no upper limit in the existence ratio of the $R_1T_4B_4$ phase, it is possible to raise the existence ratio to approximately 10/24.5 (portions/$mm^2$).

Further, the R-T-B based rare earth magnet according to the present embodiment preferably satisfies $\alpha_{HR/R} \geq \beta_{HR/R}$, where the $\alpha_{HR/R}$ (mass %) is a ratio of the heavy rare earth element(s) HR with respect to the rare earth element(s) R in the $R_1T_4B_4$ phase and the $\beta_{HR/R}$ (mass %) a ratio of the heavy rare earth element(s) HR with respect to the rare earth element(s) R in the R-T-B based rare earth magnet. The composition of each $R_1T_4B_4$ phase can be specified by measuring the composition of the white portion in FIG. 3 with EPMA.

The ratio $\alpha_{HR/R}$ of the heavy rare earth element(s) HR to the rare earth element(s) R in the $R_1T_4B_4$ phase is preferably 5 mass % or more. Excellent properties can be obtained by setting the $\alpha_{HR/R}$ to 5 mass % or more. There is no particular upper limit for the $\alpha_{HR/R}$, but it is, for example, 40 mass % or less.

<Process for Production of R-T-B Based Rare Earth Magnet>

Next, a process for production of the R-T-B based rare earth magnet according to the present embodiment is described.

Hereinafter, an R-T-B based rare earth magnet manufactured by powder metallurgy process in which a heavy rare earth element(s) are diffused in the grain boundary will be described as an example, but the process for production of the R-T-B based rare earth magnet according to the present embodiment is not particularly limited thereto and the other methods can also be used.

The process for production of the R-T-B based rare earth magnet according to the present embodiment includes a compacting process of pressing raw material powder to obtain a green compact, a sintering process of sintering the green compact to obtain a sintered body, and an aging process of maintaining the sintered body at a temperature lower than the sintering temperature for a certain period of time.

Hereinafter, the process for production of the R-T-B based rare earth magnet will be described in detail, but well-known methods may be used for methods not described below.

[Preparation Process of Raw Material Powder]

Raw material powder can be prepared by a well-known method. In the present embodiment, the R-T-B based rare earth magnet is manufactured by a two-alloy method using an alloy mainly including the $R_2T_{14}B$ phase and an additive mainly including the $R_1T_4B_4$ phase. Here, the composition of the alloy, the composition of the additive, and amount of the additive are controlled to obtain the composition of the R-T-B based rare earth magnet to be finally obtained.

First, raw material metals corresponding to the composition of the alloy according to the present embodiment are prepared, and an alloy corresponding to the present embodiment is produced from the raw material metals. There is no limitation on the method for producing the alloy. For example, the alloy can be produced by a strip casting method.

After producing the alloy, the produced alloy is pulverized (a pulverizing process). The pulverizing process may be carried out in two steps or in one step. The method of pulverization is not particularly limited. For example, it is carried out by a method using various pulverizers. For example, the pulverizing process may be carried out in two stages of a coarse pulverization process and a fine pulverization process, and for example, a hydrogen crushing treatment may be carried out as the coarse pulverization process. Specifically, it is possible to carry out, after absorbing hydrogen at room temperature into the raw material alloy, dehydrogenation at 300° C. or more and 650° C. or less in Ar gas atmosphere for 0.5 hour or more and five hours or less. Further, the fine pulverization process may be carried out by using a jet mill, a ball mill, etc., afteroleic acid amide, zinc stearate, or the like is added to the powder after the coarse pulverization. There is no particular limitation on the particle diameter of the fine pulverized powder to be obtained. For example, the fine pulverization can be carried out to obtain finely pulverized powder having a particle diameter (D50) of 3 μm or more and 5 μm or less.

Next, raw material metals corresponding to the composition of the additive according to the present embodiment are prepared, and an additive alloy corresponding to the present embodiment is produced from the raw material metals. There is no particular limitation on the method for producing the additive. For instance, alloys can be produced by sequentially performing arc melting, high-frequency melting and solution treatment. The conditions of each treatment can be a general condition, and there is no particular limitation.

Next, by pulverizing the obtained additive alloy with a jaw crusher, a brown mill, etc., an additive having a particle diameter (D50) of, for example, 10 μm or more and 300 μm or less can be obtained. It can also be confirmed that the $R_1T_4B_4$ phase is formed by X-ray diffraction measurement to the additive at this step.

Next, a predetermined amount of the additive is added to the finely pulverized powder and mixed therewith so that pulverized powder before pressing is obtained.

[Compacting Process]

In the compacting process, the pulverized powder obtained by the pulverizing process is pressed to a predetermined shape. Although the pressing method is not particularly limited, the pulverized powder is filled in a metal mold and pressurized in a magnetic field in the present embodiment.

The pressure applied when pressing is preferably 10 MPa or more and 200 MPa or less. The applied magnetic field is preferably 500 kA/m or more and 5,000 kA/m or less. The shape of the green compact obtained by pressing the pulverized powder is not particularly limited, and it may be in an arbitrary shape according to the shape of the desired R-T-B based rare earth magnet such as a rectangular parallelepiped, a flat plate, a column, etc.

[Sintering Process]

The sintering process is a process of sintering the green compact in a vacuum or inert gas atmosphere to obtain a sintered body. The sintering temperature needs to be adjusted according to various conditions such as a composition, a pulverization method, a particle diameter and a particle diameter distribution, etc., however, the green compact is, for example, sintered by heat treatment at 950° C. or more and 1100° C. or less in vacuum or in the presence of an inert gas for one hour or more and 20 hours or less. Thereby, a sintered body of a high density can be obtained.

[Aging Process]

The aging process is carried out by heating the sintered body after the sintering process at a temperature lower than the sintering temperature. There is no particular limitation on the temperature and time of the aging, however, it can be carried out, for example, at 470° C. or more and 570° C. or less for 0.5 hour or more and three hours or less.

[Diffusion Process]

The present embodiment may include a diffusion process, in which the heavy rare earth element(s) are further diffused to the sintered body. The diffusion can be carried out by adhering, for example, a compound including the heavy rare earth element(s) on the surface of a sintered body which has been subjected to pretreatment if necessary, and then heat treating thereof. Thus, a concentration gradient of the heavy rare earth element(s) can be generated from the surface of the magnet toward the inside of the magnet. HcJ of the finally obtained R-T-B based rare earth magnet can be further improved. There is no particular limitation on the details of the pretreatment, and a pretreatment in which etching is carried out by a known method, followed by washing and drying is exemplified.

The diffusion process can be performed at a temperature 100 to 200° C. lower than that in the sintering process. However, by diffusing the heavy rare earth element(s), the composition balance of the R-T-B based rare earth magnet tends to fluctuate especially when the B content is small, a different phase such as $R_2T_{17}$ phase may generate, and HcJ may be rather lowered. In the present embodiment, it is possible to prevent generation of the different phase by including the $R_1T_4B_4$ phase.

As the heavy rare earth element(s) diffused by the diffusion, Dy or Tb is preferable, and Dy is more preferable.

There is no particular limitation on the method for adhering the heavy rare earth element(s). For example, there are methods using vapor deposition, sputtering, electroplating, spray applying, brush coating, jet dispenser, nozzle, screen printing, squeegee printing, sheet construction method, etc.

In the present embodiment, a coating material including a heavy rare earth element(s) is prepared and the coating material is applied to one or more surfaces of the sintered body.

Formation of the coating material is not particularly limited. There is no particular limitation on the heavy rare earth element(s) to be used. In addition, examples of the heavy rare earth compounds including heavy rare earth element(s) are alloys, oxides, halides, hydroxides, and hydrides, and hydrides are particularly preferable. Examples of the hydrides of the heavy rare earth element are $DyH_2$, $TbH_2$, hydrides of Dy—Fe and hydrides of Tb—Fe. In particular, $DyH_2$ or $TbH_2$ is preferable.

The heavy rare earth compound is preferably in the form of particles. The average particle diameter is preferably 100 nm to 50 μm, and more preferably 1 μm to 10 μm.

As a solvent to be used for the coating material, it is preferable to use a solvent capable of uniformly dispersing the heavy rare earth compound without dissolving it. For example, alcohols, aldehydes, ketones, etc. can be mentioned; ethanol is preferable among all.

The content of the heavy rare earth compound in the coating material is not particularly limited. For example, it may be 10 to 50 mass %. If necessary, the coating material may further include components other than the heavy rare earth compound. Dispersants for preventing aggregation of heavy rare earth compound particles can be exemplified.

When using the diffusion process, it is necessary to provide the aging process also after the diffusion process.

[Machining Process after the Diffusion]

After the diffusion process, a residual layer remaining on the surface of the main surface may be removed, when necessary. There is no particular limitation on the type of the machining to be performed in the machining process after the diffusion. For example, a chemical removal method, a shape machining such as physical cutting and grinding, a chamfer machining such as barrel polishing, etc. may be performed after the diffusion.

The R-T-B based rare earth magnet obtained by the above process may be subjected to surface treatment such as plating, resin coating, oxidation treatment, chemical conversion treatment, etc. Thus, the corrosion resistance can be further improved.

Further, it is possible to use a magnet obtained by cutting and dividing the R-T-B based rare earth magnet of the present embodiment.

Specifically, the R-T-B based rare earth magnet according to the present embodiment is suitably used for motors, compressors, magnetic sensors, speakers, etc.

In addition, the R-T-B based rare earth magnet according to the present embodiment may be used alone, or two or more of the R-T-B based rare earth magnets combined as required may be used. The combining method is not particularly limited. For example, there is a method of mechanically combining and a method of combining by resin molding.

By combining two or more R-T-B based rare earth magnets, it is possible to easily manufacture a large R-T-B based rare earth magnet. Magnets in which two or more R-T-B based rare earth magnets are combined, are preferably used for applications requiring a particularly large R-T-B based rare earth magnet, such as IPM motors, wind power generators, and large motors.

It should be noted that the present invention is not limited to the above-described embodiments, and can be variously modified within the scope of the present invention.

EXAMPLES

Hereinafter, the invention will be described in detail referring to Examples; however, the invention is not limited thereto.

Example 1

First, alloy A having the composition described in the following Table 1 was prepared by a strip casting method.

Subsequently, the alloy A was subjected to a hydrogen pulverization treatment (coarse pulverization) to obtain coarse pulverized powder A. Specifically, hydrogen was absorbed at room temperature to the raw material alloy, and then dehydrogenation was performed at 600° C. for one hour in Ar gas atmosphere.

Next, 0.1 mass % of oleic acid amide as a pulverization aid was added to the coarse pulverized powder A, and mixed thereof using a Nauta mixer. Thereafter, fine pulverization was carried out by a jet mill using $N_2$ gas to obtain finely pulverized powder A having a particle diameter D50 of approximately 4.0 μm.

Addition alloy "a" having the composition described in Table 2 below was prepared. The additive alloy "a" was prepared by arc melting the raw material metal, melting at high frequency, and subjecting it to a solution treatment. The arc melting was carried out by repeating melting and casting three times in an arc melting furnace. The high-frequency melting was performed by carrying out high-frequency induction heating on the raw material metals after the arc melting. The solution treatment was carried out by holding at 1200° C. for 200 hours in Ar atmosphere.

Next, the additive alloy "a" was pulverized with a jaw crusher or a brown mill to obtain the additive "a" having a particle diameter D50 of approximately 100 It was confirmed that a $Nd_1Fe_4B_4$ phase was formed in the additive alloy "a" by carrying out X-ray diffraction measurement to the additive "a".

Next, 0.4 mass % of the additive "a" was added to the finely pulverized powder A. Then, it was filled in a mold disposed in an electromagnet, pressed thereof in magnetic field by applying pressure of 50 MPa while applying a magnetic field of 1600 kA/m, and 11 green compacts were obtained.

11 sintered bodies were obtained by sintering the obtained 11 green compacts at different temperatures, from 1000° C. to 1100° C. at intervals of 10° C. The sintering time was six hours, and the aging was carried out at 550° C. for one hour after the sintering.

The compositions were confirmed for the obtained 11 sintered bodies. As a result, it was confirmed that the compositions of the obtained sintered bodies were the compositions shown in Table 3. The compositions shown in Table 3 substantially match an average composition of the powder, in which 0.4 mass % of the additive "a" is added to the finely pulverized powder A. That is, the composition of the powder does not substantially change by the compacting process or sintering process.

Br, HcJ and Hk/HcJ of the obtained 11 sintered bodies were measured using a B-H tracer. Hk was made to the magnitude of the magnetic field when magnetization reaches 90% of Br. The results are shown in Table 4. Further, the sintered body, having the highest sintering temperature among the sintered bodies having Hk/HcJ of 95% or more, was cut at an arbitrary surface and the obtained cross section was observed by EPMA. Then, it was confirmed that the $R_1T_4B_4$ phase was present. The existence ratio of the $R_1T_4B_4$ phase and the average of the equivalent circle diameters were measured. Furthermore, the ratio ($\alpha_{HR/R}$) of heavy rare earth element(s) HR with respect to the rare earth element(s) R in the $R_1T_4B_4$ phase was measured by EPMA. The ratio $\beta_{HR/R}$ (mass %) of the heavy rare earth element(s) HR with respect to the rare earth element(s) R in the entire sintered body (R-T-B based rare earth magnet) was calculated from Table 3. The results are shown in Table 4. Br and HcJ described in Table 4 are the values for the sintered body having the highest sintering temperature among the sintered bodies having Hk/HcJ of 95% or more.

Comparative Example 1

Production of the sintered body and measurement of its properties were carried out in the same manner as in Example 1, except alloy B in Table 1 was used and the additive was not used. The results are shown in Tables 1 to 4.

Relative to Comparative Example 1, Example 1 has a wider temperature range, in which Hk/HcJ of 95% can be obtained, and an improved HcJ.

Example 2

Among the sintered bodies of Example 1, the sintered body having the highest sintering temperature among the sintered bodies having Hk/HcJ of 95% or more, that is, the sintered body having the sintering temperature of 1060° C. was cut out to a rectangular parallelepiped shape of 10 mm×7.0 mm×3.5 mm. At this time, the direction of the 3.5 mm side was set to be the direction in which the magnetic field was applied during the pressing in the magnetic field.

Next, the rectangular parallelepiped shaped sintered body was subjected to Dy diffusion. A detailed method of the diffusion is described below.

Pretreatment of the diffusion process was carried out to the rectangular parallelepiped shaped sintered body by performing the following treatment twice. The treatment includes an immersion in a mixed solution of nitric acid and ethanol for three minutes and a subsequent immersion in ethanol for one minute. After the pretreatment, the sintered body was washed and dried.

Also, a Dy-included coating material to apply to the sintered body was prepared. $DyH_2$ raw material was finely pulverized by a jet mill using $N_2$ gas, and $DyH_2$ fine powder was prepared. Subsequently, the $DyH_2$ fine powder was mixed with an alcohol solvent and dispersed in the alcohol solvent to form a coating material. Then, the Dy-included coating material was obtained.

Next, the Dy-included coating material was applied by brush application to all six faces of the rectangular parallelepiped shaped sintered body. The total application amount of $DyH_2$ at this time was made 0.5 mass %.

The sintered body after applying the Dy-included coating material was subjected to diffusion at 900° C. for 24 hours, and then aging at 550° C. for one hour. Various measurements were carried out in the same manner as the above Example 1. The measurement region was the entire cross section of 7.0 mm×3.5 mm. The composition of the finally obtained sintered body is shown in Table 3, and the results of various measurements are shown in Table 4. The column of "Temperature range at which Hk/HcJ of 95% is obtainable" in Example 2 shows the result obtained by actually measuring Hk/HcJ after the grain boundary diffusion of all the 11 sintered bodies in Example 1. That is, "Temperature range at which Hk/HcJ of 95% is obtainable" before and after the grain boundary diffusion did not change.

Comparative Example 2

Comparative Example 2 was carried out in the same manner as Example 2, except the sintered body having the highest sintering temperature of the sintered bodies having Hk/HcJ of 95% or more, among the sintered bodies of Comparative Example 1 was used. The composition of the finally obtained sintered body is shown in Table 3, and the results of various measurements are shown in Table 4.

HcJ of Example 2 improved relative to the same of Comparative Example 2.

Examples 3 to 11 and Comparative Examples 3 to 4

The sintered bodies of the respective Examples and Comparative Examples were prepared in the same manner as in Example 1 (without diffusion) or Example 2 (with diffusion), except that the various alloys listed in Table 1 and the various additives listed in Table 2 were combined in the combinations shown in Table 5. Then, the properties of the sintered bodies were measured. The compositions of the finally obtained sintered bodies are shown in Table 3, and the results of various measurements are shown in Table 4.

TABLE 1

| | Nd [mass %] | Pr [mass %] | Dy [mass %] | Al [mass %] | Co [mass %] | Cu [mass %] | Ga [mass %] | Zr [mass %] | Mn [mass %] | B [mass %] | Fe [mass %] |
|---|---|---|---|---|---|---|---|---|---|---|---|
| Alloy A | 22.0 | 6.5 | 1.4 | 0.3 | 2 | 0.1 | 0.1 | 0.05 | 0.04 | 0.88 | bal. |
| Alloy B | 22.0 | 6.5 | 1.5 | 0.3 | 2 | 0.1 | 0.1 | 0.05 | 0.04 | 0.92 | bal. |
| Alloy C | 22.0 | 6.5 | 1.4 | 0.3 | 2 | 0.1 | 0.1 | 0.05 | 0.04 | 0.74 | bal. |
| Alloy D | 22.0 | 6.5 | 1.4 | 0.3 | 2 | 0.1 | 0.1 | 0.05 | 0.04 | 0.76 | bal. |
| Alloy E | 22.0 | 6.5 | 1.4 | 0.3 | 2 | 0.1 | 0.1 | 0.05 | 0.04 | 0.81 | bal. |
| Alloy F | 22.0 | 6.5 | 1.4 | 0.3 | 2 | 0.1 | 0.1 | 0.05 | 0.04 | 0.92 | bal. |
| Alloy G | 22.0 | 6.5 | 1.4 | 0.3 | 2 | 0.1 | 0.1 | 0.05 | 0.04 | 0.94 | bal. |
| Alloy H | 22.0 | 6.5 | 1.4 | 0.3 | 2 | 0.1 | 0.1 | 0.05 | 0.04 | 0.96 | bal. |
| Alloy I | 22.0 | 6.5 | 0.5 | 0.3 | 2 | 0.1 | 0.1 | 0.05 | 0.04 | 0.81 | bal. |
| Alloy J | 22.0 | 6.5 | 0 | 0.3 | 2 | 0.1 | 0.1 | 0.05 | 0.04 | 0.81 | bal. |

TABLE 2

| | Nd [mass %] | Dy [mass %] | B [mass %] | Fe [mass %] |
|---|---|---|---|---|
| Additive a | 20.0 | 19.0 | 10.0 | bal. |
| Additive b | 38.0 | 0.0 | 10.0 | bal. |
| Additive c | 37.4 | 0.6 | 10.0 | bal. |

TABLE 3

| | Nd [mass %] | Pr [mass %] | Dy [mass %] | R in total [mass %] | Al [mass %] | Co [mass %] | Cu [mass %] | Ga [mass %] | Zr [mass %] | Mn [mass %] | B [mass %] | Fe [mass %] |
|---|---|---|---|---|---|---|---|---|---|---|---|---|
| Ex. 1 | 22.0 | 6.5 | 1.5 | 30.0 | 0.3 | 2 | 0.1 | 0.1 | 0.05 | 0.04 | 0.92 | bal. |
| Ex. 2 | 22.0 | 6.5 | 2.0 | 30.5 | 0.3 | 2 | 0.1 | 0.1 | 0.05 | 0.04 | 0.92 | bal. |
| Ex. 3 | 22.0 | 6.5 | 1.4 | 29.9 | 0.3 | 2 | 0.1 | 0.1 | 0.05 | 0.04 | 0.90 | bal. |
| Ex. 4 | 22.0 | 6.5 | 1.4 | 29.9 | 0.3 | 2 | 0.1 | 0.1 | 0.05 | 0.04 | 0.92 | bal. |
| Ex. 5 | 22.0 | 6.5 | 1.5 | 30.0 | 0.3 | 2 | 0.1 | 0.1 | 0.05 | 0.04 | 0.80 | bal. |
| Ex. 6 | 22.0 | 6.5 | 1.5 | 30.0 | 0.3 | 2 | 0.1 | 0.1 | 0.05 | 0.04 | 0.85 | bal. |
| Ex. 7 | 22.0 | 6.5 | 1.5 | 30.0 | 0.3 | 2 | 0.1 | 0.1 | 0.05 | 0.04 | 0.96 | bal. |
| Ex. 8 | 22.0 | 6.5 | 1.5 | 30.0 | 0.3 | 2 | 0.1 | 0.1 | 0.05 | 0.04 | 0.98 | bal. |
| Ex. 9 | 22.0 | 6.5 | 0.9 | 29.4 | 0.3 | 2 | 0.1 | 0.1 | 0.05 | 0.04 | 0.85 | bal. |
| Ex. 10 | 22.0 | 6.5 | 0.0 | 28.5 | 0.3 | 2 | 0.1 | 0.1 | 0.05 | 0.04 | 0.85 | bal. |
| Ex. 11 | 22.0 | 6.5 | 1.5 | 30.0 | 0.3 | 2 | 0.1 | 0.1 | 0.05 | 0.04 | 0.96 | bal. |
| Comp. Ex. 1 | 22.0 | 6.5 | 1.5 | 30.0 | 0.3 | 2 | 0.1 | 0.1 | 0.05 | 0.04 | 0.92 | bal. |
| Comp. Ex. 2 | 22.0 | 6.5 | 2.0 | 30.5 | 0.3 | 2 | 0.1 | 0.1 | 0.05 | 0.04 | 0.92 | bal. |
| Comp. Ex. 3 | 22.0 | 6.5 | 1.5 | 30.0 | 0.3 | 2 | 0.1 | 0.1 | 0.05 | 0.04 | 0.78 | bal. |
| Comp. Ex. 4 | 22.0 | 6.5 | 1.5 | 30.0 | 0.3 | 2 | 0.1 | 0.1 | 0.05 | 0.04 | 1.00 | bal. |

TABLE 4

| | Squareness ratio of 95% obtainable temperature range [° C.] | Existence density of $R_1T_4B_4$ phase [portion/24.5 $mm^2$] | Equivalent circle diameter of $R_1T_4B_4$ phase [μm] | $\beta_{HR/R}$ [mass %] | $\alpha_{HR/R}$ [mass %] | Br [mT] | HcJ [kA/m] |
|---|---|---|---|---|---|---|---|
| Ex. 1 | 1030~1060 | 7 | 85 | 5 | 40 | 1382 | 1415 |
| Ex. 2 | 1030~1060 | 5 | 75 | 7 | 35 | 1375 | 2051 |
| Ex. 3 | 1040~1060 | 6 | 70 | 5 | 25 | 1379 | 1402 |
| Ex. 4 | 1050~1060 | 3 | 54 | 5 | 10 | 1371 | 1944 |
| Ex. 5 | 1050~1060 | 4 | 71 | 5 | 31 | 1379 | 1898 |
| Ex. 6 | 1040~1060 | 4 | 73 | 5 | 35 | 1378 | 2061 |
| Ex. 7 | 1030~1060 | 6 | 76 | 5 | 35 | 1373 | 1981 |
| Ex. 8 | 1030~1070 | 7 | 78 | 5 | 36 | 1365 | 1891 |
| Ex. 9 | 1050~1060 | 3 | 17 | 3 | 5 | 1401 | 1899 |
| Ex. 10 | 1050~1060 | 1 | 9 | 0 | 0 | 1409 | 1855 |
| Ex. 11 | 1030~1060 | 5 | 72 | 35 | 35 | 1370 | 1956 |
| Comp. Ex. 1 | 1050 | 0 | — | 5 | — | 1370 | 1375 |
| Comp. Ex. 2 | 1050 | 0 | — | 7 | — | 1361 | 1815 |
| Comp. Ex. 3 | — | 2 | 65 | 5 | 31 | 1358 | 2080 |
| Comp. Ex. 4 | 1020~1070 | 10 | 81 | 5 | 33 | 1357 | 1721 |

TABLE 5

| | Alloy | Additive | Amount of Additive (mass %) | Diffusion process |
|---|---|---|---|---|
| Ex. 1 | A | a | 0.4 | not done |
| Ex. 2 | A | a | 0.4 | done |
| Ex. 3 | A | a | 0.2 | not done |
| Ex. 4 | A | b | 0.4 | done |
| Ex. 5 | D | a | 0.4 | done |
| Ex. 6 | E | a | 0.4 | done |
| Ex. 7 | F | a | 0.4 | done |
| Ex. 8 | G | a | 0.4 | done |
| Ex. 9 | I | b | 0.4 | done |
| Ex. 10 | J | b | 0.4 | done |
| Ex. 11 | B | c | 0.4 | done |
| Comp. Ex. 1 | B | — | — | not done |
| Comp. Ex. 2 | B | — | — | done |
| Comp. Ex. 3 | C | a | 0.4 | done |
| Comp. Ex. 4 | H | a | 0.4 | done |

Example 3 was in the same condition as in Example 1, except addition amount of the additive "a" was decreased. Relative to Example 1, Example 3 shows smaller ratio (a HR/R) of the heavy rare earth element(s) HR to rare earth elements R in the $R_1T_4B_4$ phase and narrower temperature range at which Hk/HcJ of 95% is obtainable.

Example 4 is in the same condition as in Example 1, except that type of the additive is changed to additive "b" which do not include Dy. Relative to Example 1, Example 4 shows smaller ratio ($\alpha_{HR/R}$) of the heavy rare earth element(s) HR to the rare earth element(s) R in the $R_1T_4B_4$ phase and narrower temperature range at which Hk/HcJ of 95% can be obtained.

Examples 2, 5 to 8 and Comparative Examples 3 and 4 are examples and Comparative Examples in which only the B content was changed. In Examples in which the B content was within the predetermined range, the $R_1T_4B_4$ phase was confirmed, and preferable properties were obtained. In contrast, Comparative Example 3, in which the B content was too small, showed less than 95% of Hk/HcJ in all the sintered bodies. Comparative Example 4, in which the B content was too large, showed lower Br and HcJ than those in Examples 2 and 5 to 8.

In Comparative Example 3, the sintered body having a sintering temperature of 1050° C. was regarded as "the sintered body having the highest sintering temperature among the sintered bodies having Hk/HcJ of 95% or more" in each example; existence ratio of the $R_1T_4B_4$ phase, the average of equivalent circle diameters, the $\alpha_{HR/R}$ and $\beta_{HR/R}$, Br, and HcJ thereof were measured.

Examples 6, 9 and 10 were conducted under the same conditions, except that the content of Dy in the alloys and the composition of the additive were changed.

Relative to Example 6, the $\alpha_{HR/R}$ and the $\beta_{HR/R}$ were lower in Examples 9 and 10, and the $\alpha_{HR/R}=\beta_{HR/R}=0$ in Example 10. Furthermore, the existence ratio of the $R_1T_4B_4$ phase is also lower than that in Example 6. As a result, relative to Example 6, Examples 9 and 10 had narrower temperature range at which Hk/HcJ of 95% can be obtained.

In Examples 7 and 11, the compositions of the entire sintered bodies are the same. However, by changing the Dy content included in the alloy and the Dy content included in the additive, only the ratio the $\beta_{HR/R}$ of the heavy rare earth element(s) HR with respect to the rare earth element(s) R in the entire sintered bodies was greatly changed.

Compared with Example 11 in which $\alpha_{HR/R}=\beta_{HR/R}$, Example 7 in which $\alpha_{HR/R}-\beta_{HR/R}=30\%$ showed higher HcJ.

Examples 21 to 33

The results conducted under the same conditions with Example 2, except alloy A was changed to alloys A1 to A13 shown in Table 6, are shown in Examples 21 to 33 in Tables 7 and 8.

TABLE 6

| | Nd [mass %] | Pr [mass %] | Dy [mass %] | Al [mass %] | Co [mass %] | Cu [mass %] | Ga [mass %] | Zr [mass %] | Mn [mass %] | B [mass %] | Fe [mass %] |
|---|---|---|---|---|---|---|---|---|---|---|---|
| Alloy A | 22.0 | 6.5 | 1.4 | 0.3 | 2 | 0.1 | 0.1 | 0.05 | 0.04 | 0.88 | bal. |
| Alloy A1 | 28.5 | 0.0 | 1.4 | 0.3 | 2 | 0.1 | 0.1 | 0.05 | 0.04 | 0.88 | bal. |
| Alloy A2 | 21.0 | 6.5 | 1.4 | 0.3 | 2 | 0.1 | 0.1 | 0.05 | 0.04 | 0.88 | bal. |

TABLE 6-continued

| | Nd [mass %] | Pr [mass %] | Dy [mass %] | Al [mass %] | Co [mass %] | Cu [mass %] | Ga [mass %] | Zr [mass %] | Mn [mass %] | B [mass %] | Fe [mass %] |
|---|---|---|---|---|---|---|---|---|---|---|---|
| Alloy A3 | 25.0 | 6.5 | 1.4 | 0.3 | 2 | 0.1 | 0.1 | 0.05 | 0.04 | 0.88 | bal. |
| Alloy A4 | 22.0 | 6.5 | 1.4 | 0.03 | 2 | 0.1 | 0.1 | 0.05 | 0.04 | 0.88 | bal. |
| Alloy A5 | 22.0 | 6.5 | 1.4 | 0.4 | 2 | 0.1 | 0.1 | 0.05 | 0.04 | 0.88 | bal. |
| Alloy A6 | 22.0 | 6.5 | 1.4 | 0.3 | 2 | 0.01 | 0.1 | 0.05 | 0.04 | 0.88 | bal. |
| Alloy A7 | 22.0 | 6.5 | 1.4 | 0.3 | 2 | 0.3 | 0.1 | 0.05 | 0.04 | 0.88 | bal. |
| Alloy A8 | 22.0 | 6.5 | 1.4 | 0.3 | 2 | 0.1 | 0.1 | 0.03 | 0.04 | 0.88 | bal. |
| Alloy A9 | 22.0 | 6.5 | 1.4 | 0.3 | 2 | 0.1 | 0.1 | 0.7 | 0.04 | 0.88 | bal. |
| Alloy A10 | 22.0 | 6.5 | 1.4 | 0.3 | 2 | 0.1 | 0.1 | 0.05 | 0.01 | 0.88 | bal. |
| Alloy A11 | 22.0 | 6.5 | 1.4 | 0.3 | 2 | 0.1 | 0.1 | 0.05 | 0.1 | 0.88 | bal. |
| Alloy A12 | 22.0 | 6.5 | 1.4 | 0.3 | 0.1 | 0.1 | 0.1 | 0.05 | 0.04 | 0.88 | bal. |
| Alloy A13 | 22.0 | 6.5 | 1.4 | 0.3 | 3 | 0.1 | 0.1 | 0.05 | 0.04 | 0.88 | bal. |

TABLE 7

| | Alloy | Nd [mass %] | Pr [mass %] | Dy [mass %] | Tb [mass %] | R in total [mass %] | Al [mass %] | Co [mass %] | Cu [mass %] | Ga [mass %] | Zr [mass %] | Mn [mass %] | B [mass %] | Fe [mass %] |
|---|---|---|---|---|---|---|---|---|---|---|---|---|---|---|
| Ex. 2 | Alloy A | 22.0 | 6.5 | 2.0 | 0.0 | 30.5 | 0.3 | 2 | 0.1 | 0.1 | 0.05 | 0.04 | 0.92 | bal. |
| Ex. 21 | Alloy A1 | 28.5 | 0.0 | 2.0 | 0.0 | 30.5 | 0.3 | 2 | 0.1 | 0.1 | 0.05 | 0.04 | 0.92 | bal. |
| Ex. 22 | Alloy A2 | 21.0 | 6.5 | 2.0 | 0.0 | 29.5 | 0.3 | 2 | 0.1 | 0.1 | 0.05 | 0.04 | 0.92 | bal. |
| Ex. 23 | Alloy A3 | 25.0 | 6.5 | 2.0 | 0.0 | 33.5 | 0.3 | 2 | 0.1 | 0.1 | 0.05 | 0.04 | 0.92 | bal. |
| Ex. 24 | Alloy A4 | 22.0 | 6.5 | 2.0 | 0.0 | 30.5 | 0.03 | 2 | 0.1 | 0.1 | 0.05 | 0.04 | 0.92 | bal. |
| Ex. 25 | Alloy A5 | 22.0 | 6.5 | 2.0 | 0.0 | 30.5 | 0.4 | 2 | 0.1 | 0.1 | 0.05 | 0.04 | 0.92 | bal. |
| Ex. 26 | Alloy A6 | 22.0 | 6.5 | 2.0 | 0.0 | 30.5 | 0.3 | 2 | 0.01 | 0.1 | 0.05 | 0.04 | 0.92 | bal. |
| Ex. 27 | Alloy A7 | 22.0 | 6.5 | 2.0 | 0.0 | 30.5 | 0.3 | 2 | 0.3 | 0.1 | 0.05 | 0.04 | 0.92 | bal. |
| Ex. 28 | Alloy A8 | 22.0 | 6.5 | 2.0 | 0.0 | 30.5 | 0.3 | 2 | 0.1 | 0.1 | 0.03 | 0.04 | 0.92 | bal. |
| Ex. 29 | Alloy A9 | 22.0 | 6.5 | 2.0 | 0.0 | 30.5 | 0.3 | 2 | 0.1 | 0.1 | 0.7 | 0.04 | 0.92 | bal. |
| Ex. 30 | Alloy A10 | 22.0 | 6.5 | 2.0 | 0.0 | 30.5 | 0.3 | 2 | 0.1 | 0.1 | 0.05 | 0.01 | 0.92 | bal. |
| Ex. 31 | Alloy A11 | 22.0 | 6.5 | 2.0 | 0.0 | 30.5 | 0.3 | 2 | 0.1 | 0.1 | 0.05 | 0.1 | 0.92 | bal. |
| Ex. 32 | Alloy A12 | 22.0 | 6.5 | 2.0 | 0.0 | 30.5 | 0.3 | 0.1 | 0.1 | 0.1 | 0.05 | 0.04 | 0.92 | bal. |
| Ex. 33 | Alloy A13 | 22.0 | 6.5 | 2.0 | 0.0 | 30.5 | 0.3 | 3 | 0.1 | 0.1 | 0.05 | 0.04 | 0.92 | bal. |

TABLE 8

| | squareness ratio of 95% obtainable temperature range [° C.] | Existence density of $R_1T_4B_4$ phase [piece/24.5 $mm^2$] | Average of an equivalent circle diameter of $R_1T_4B_4$ phase [μm] | $\beta_{HR/R}$ [mass %] | $\alpha_{HR/R}$ [mass %] | Br [mT] | HcJ [kA/m] |
|---|---|---|---|---|---|---|---|
| Ex. 2 | 1030~1060 | 5 | 75 | 7 | 35 | 1375 | 2051 |
| Ex. 21 | 1030~1060 | 5 | 76 | 7 | 35 | 1372 | 2058 |
| Ex. 22 | 1050~1080 | 4 | 82 | 7 | 33 | 1398 | 1956 |
| Ex. 23 | 1010~1040 | 6 | 58 | 6 | 38 | 1356 | 2111 |
| Ex. 24 | 1030~1060 | 5 | 72 | 7 | 36 | 1391 | 1889 |
| Ex. 25 | 1030~1060 | 5 | 77 | 7 | 34 | 1361 | 2074 |
| Ex. 26 | 1030~1060 | 6 | 79 | 7 | 33 | 1382 | 1830 |
| Ex. 27 | 1030~1060 | 4 | 68 | 7 | 36 | 1373 | 2061 |
| Ex. 28 | 1040~1050 | 5 | 72 | 7 | 37 | 1379 | 2071 |
| Ex. 29 | 1030~1070 | 5 | 79 | 7 | 8 | 1369 | 2089 |
| Ex. 30 | 1040~1060 | 5 | 68 | 7 | 29 | 1377 | 2060 |
| Ex. 31 | 1020~1060 | 5 | 84 | 7 | 38 | 1370 | 2043 |
| Ex. 32 | 1030~1060 | 5 | 74 | 7 | 33 | 1379 | 2059 |
| Ex. 33 | 1030~1060 | 5 | 75 | 7 | 34 | 1371 | 2042 |

According to Examples 21 to 33, although the composition of the main phase alloy was changed, when the B content in the finally obtained R-T-B based rare earth magnet was within the predetermined range and included the $R_1T_4B_4$ phase, temperature range at which Hk/HcJ of 95% is obtainable was widened and HcJ was improved.

The invention claimed is:

1. A rare earth magnet including R, T and B, wherein R is one or more rare earth elements, T is one or more transition metal elements comprising Fe, or Fe and Co, B is boron, a B content with respect to a total rare earth magnet is 0.80 mass % or more and 0.98 mass % or less, the rare earth magnet includes an $R_1T_4B_4$ phase, and an average of an equivalent circle diameter of the $R_1T_4B_4$ phase in a cross section of the rare earth magnet is 50 μm or more.

2. The rare earth magnet according to claim 1, wherein a heavy rare earth element(s) HR is included as the rare earth element(s) R in the $R_1T_4B_4$ phase, and $\alpha_{HR/R} \geq 5$, where the $\alpha_{HR/R}$(mass %) is a ratio of the heavy rare earth element(s) HR with respect to the rare earth element(s) R in the $R_1T_4B_4$ phase.

3. The rare earth magnet according to claim 2, wherein $\alpha_{HR/R} \geq \beta_{HR/R}$, where the $\beta_{HR/R}$(mass %) is a ratio of the heavy rare earth element(s) HR with respect to the rare earth element(s) R in the rare earth magnet.

4. The rare earth magnet according to claim 2, having a concentration gradient of the heavy rare earth element(s) from a surface of the magnet toward inside of the magnet.

5. The rare earth magnet according to claim 3, having a concentration gradient of the heavy rare earth element from a surface of the magnet toward inside of the magnet.

6. The rare earth magnet according to claim 1, wherein an existence ratio of the $R_1T_4B_4$ phase in the cross section of the rare earth magnet is 1/24.5 (portion/$mm^2$) or more.

7. The rare earth magnet according to claim 2, wherein an existence ratio of the $R_1T_4B_4$ phase in the cross section of the rare earth magnet is 1/24.5 (portion/$mm^2$) or more.

8. The rare earth magnet according to claim 3, wherein an existence ratio of the $R_1T_4B_4$ phase in the cross section of the rare earth magnet is 1/24.5 (portion/$mm^2$) or more.

9. The rare earth magnet according to claim 4, wherein an existence ratio of the $R_1T_4B_4$ phase in the cross section of the rare earth magnet is 1/24.5 (portion/$mm^2$) or more.

10. The rare earth magnet according to claim 5, wherein an existence ratio of the $R_1T_4B_4$ phase in the cross section of the rare earth magnet is 1/24.5 (portion/$mm^2$) or more.

11. The rare earth magnet according to claim 1, wherein an R content is 27 mass % or more and 34 mass % or less.

12. The rare earth magnet according to claim 1, wherein T comprises Fe and Co, and Co content is more than 0 mass % and 3 mass % or less.

13. The rare earth magnet according to claim 1, wherein the rare earth magnet further comprises Al, and an Al content is 0.03 mass % or more and 0.4 mass % or less.

14. The rare earth magnet according to claim 1, wherein the rare earth magnet further comprises Cu, and a Cu content is 0.01 mass % or more and 0.3 mass % or less.

15. The rare earth magnet according to claim 1, wherein the rare earth magnet further comprises Zr, and a Zr content is 0.03 mass % or more and 0.7 mass % or less.

16. The rare earth magnet according to claim 1, wherein the rare earth magnet further comprises Mn, and a Mn content is 0.01 mass % or more and 0.1 mass % or less.

* * * * *